US010746476B2

(12) United States Patent
Jaccard et al.

(10) Patent No.: US 10,746,476 B2
(45) Date of Patent: Aug. 18, 2020

(54) UNDERWATER REMOTE COOLING APPARATUS

(71) Applicant: United States of America as represented by the Secretary of the Navy, San Diego, CA (US)

(72) Inventors: Gregory A. Jaccard, San Diego, CA (US); Carl E. Lostrom, San Diego, CA (US); Richard P. Johnson, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 86 days.

(21) Appl. No.: 16/246,153

(22) Filed: Jan. 11, 2019

(65) Prior Publication Data

US 2020/0173729 A1 Jun. 4, 2020

Related U.S. Application Data

(60) Provisional application No. 62/773,900, filed on Nov. 30, 2018.

(51) Int. Cl.

| | |
|---|---|
| ***F28D 15/02*** | (2006.01) |
| ***B63G 8/36*** | (2006.01) |
| ***E02D 29/045*** | (2006.01) |
| ***E02D 29/09*** | (2006.01) |

(52) U.S. Cl.

CPC ..... *F28D 15/0275* (2013.01); *B63G 8/36* (2013.01); *E02D 29/045* (2013.01); *E02D 29/06* (2013.01); *E02D 2600/00* (2013.01)

(58) Field of Classification Search

CPC ..... B63G 8/36; E02D 29/045; E02D 29/06; F28D 15/0275

See application file for complete search history.

(56) References Cited

U.S. PATENT DOCUMENTS 3,561,387 A * 2/1971 Kumm ..... B63B 27/36 114/322
3,572,426 A 3/1971 Edwards
3,783,935 A * 1/1974 Simmons ..... B60H 1/32 165/44
4,474,228 A 10/1984 Rogalski
(Continued)

*Primary Examiner* — Gordon A Jones
(74) *Attorney, Agent, or Firm* — Naval Information Warfare Center Pacific; Kyle Eppele; J. Eric Anderson

(57) ABSTRACT

A cooling apparatus for an underwater platform comprising: an evaporator block fabricated from a thermally conductive material and having a first surface that is shaped so as to releasably mate to an exterior surface contour of the underwater platform; a heat pipe having a working fluid sealed therein, wherein the heat pipe has a first end and a second end, and wherein the first end is in thermal communication with the evaporator block; a condenser block in thermal communication with the second end of the heat pipe; and a plurality of spring clamps mounted to the evaporator block and configured to bias the first surface of the evaporator block against the exterior surface of the underwater platform such that heat from the exterior surface of the underwater platform is transferred to the ambient water via the evaporator block, heat pipe, and condenser block.

19 Claims, 4 Drawing Sheets

(56) References Cited

U.S. PATENT DOCUMENTS

| | | | | |
|---|---|---|---|---|
| 6,065,418 | A * | 5/2000 | Goldstein | H02S 10/30 114/312 |
| 6,830,098 | B1 * | 12/2004 | Todd | F28D 15/0275 165/104.21 |
| 7,290,496 | B2 * | 11/2007 | Asfar | B63C 11/42 114/312 |
| 7,802,616 | B2 * | 9/2010 | Chen | H01L 23/427 165/104.33 |
| 9,897,386 | B2 * | 2/2018 | Kimball | F28F 1/08 |
| 2002/0067598 | A1 * | 6/2002 | Sathe | H01L 23/4006 361/700 |
| 2004/0035558 | A1 * | 2/2004 | Todd | H01L 23/367 165/104.26 |
| 2006/0104032 | A1 * | 5/2006 | Lee | H01L 23/427 361/700 |
| 2007/0151706 | A1 * | 7/2007 | Foster, Sr. | F28F 3/02 165/80.3 |
| 2007/0169919 | A1 * | 7/2007 | Deng | H01L 23/427 165/104.33 |
| 2008/0035310 | A1 * | 2/2008 | Hsu | H01L 23/427 165/104.21 |
| 2013/0206367 | A1 * | 8/2013 | Chen | H01L 23/467 165/104.19 |
| 2015/0075761 | A1 * | 3/2015 | Hancock | B23P 15/26 165/181 |
| 2015/0184948 | A1 * | 7/2015 | Lin | F28D 15/0275 165/104.21 |
| 2015/0354902 | A1 | 12/2015 | McDonald | |
| 2019/0056180 | A1 * | 2/2019 | Chen | F28D 15/04 |
| 2019/0203983 | A1 * | 7/2019 | Jeon | F28D 15/0275 |
| 2019/0220044 | A1 * | 7/2019 | Ruth | G06Q 10/00 |

* cited by examiner

UNDERWATER REMOTE COOLING APPARATUS

CROSS-REFERENCE TO RELATED APPLICATION

This application claims the benefit of U.S. Provisional Application No. 62/773,900, filed 30 Nov. 2018, titled "Underwater Remote Cooling Apparatus" (Navy Case #104034).

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 104034.

BACKGROUND OF THE INVENTION

Pressure vessels or other fluid-bounding enclosures can be found in a great variety of shapes, sizes, and materials to suit specific requirements including environmental conditions, serviceability, functionality, manufacturability, and other pertinent requirements. In one permutation these vessels can be standalone sealed enclosures for use in immersed ambient fluid environments such as seawater. Often such enclosures contain heat generating components such as power electronics which operate at a nominal temperature exceeding that of the ambient fluid. It is often desired to transfer the heat to the ambient fluid environment. The heat generating components are typically fastened mechanically to allow for thermal conduction through the vessel wall to the ambient fluid. For passive heat transfer these types of enclosures have traditionally relied upon direct contact between the enclosure wall and the ambient fluid to setup a thermal energy transfer by convection. In high heat flux applications extended fin surfaces on the enclosure wall are a common method to improve passive heat transfer performance. For active heat transfer systems, pumps, fans, and other powered devices assist in the heat transfer (e.g. car engine cooling system).

Remotely Operated Vehicles (ROVs) are an example of an underwater system which commonly includes pressure vessels which generate significant amounts of heat such as motor controllers, hydraulic power units, and power transformers. Typically, flotation foam is used in the upper volume of the vehicle for stability, but also in interstitial areas between components (cameras, lights, thrusters, pressure vessels, structure, etc.) for highly efficient (e.g. power, size, displacement, etc.) vehicle systems. For these complex vehicle systems, compromises are often made to achieve performance goals for speed, hydrodynamics, power efficiency, stability, buoyancy, and other factors. In these systems, pressure vessel design and flotation design may be compromised to meet opposing requirements for heat dissipation and vehicle performance. Typically, any heat generating components are located to allow maximum water flow to aid in heat transfer, but this may increase hydrodynamic drag of the vehicle leading to negative system performance. A specific instance of this may entail a motor controller pressure vessel problematically located on the ROV in order to permit heat transfer from the vessel wall to the surrounding seawater.

SUMMARY

Disclosed herein is a cooling apparatus for an underwater platform comprising and evaporator block, a heat pipe, a condenser block, and a plurality of spring clamps. The evaporator block is fabricated from a thermally conductive material and has a first surface that is shaped so as to releasably mate to an exterior surface contour of the underwater platform. The heat pipe has a working fluid sealed inside. The heat pipe has a first end and a second end. The first end is in thermal communication with the evaporator block The condenser block is in thermal communication with the second end of the heat pipe. The condenser block is held in ambient water away from the surface of the underwater platform by the heat pipe. The spring clamps are mounted to the evaporator block and configured to bias the first surface of the evaporator block against the exterior surface of the underwater platform such that heat from the exterior surface of the underwater platform is transferred to the ambient water via the evaporator block, heat pipe, and condenser block.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed apparatus below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
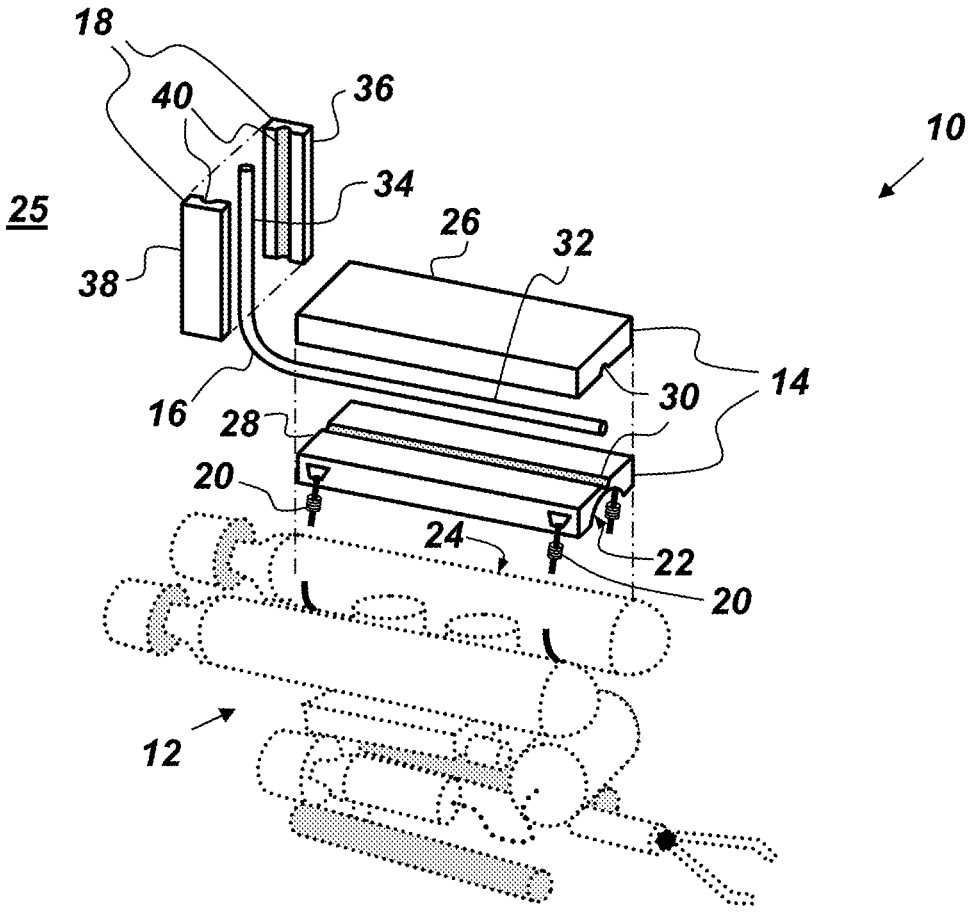
FIG. 1 is a perspective view of an embodiment of a cooling apparatus for an underwater platform.

FIG. 1 is an illustration of a cooling apparatus 10 for an underwater platform 12. The cooling apparatus 10 comprises, consists of, or consists essentially of an evaporator block 14, a heat pipe 16, a condenser block 18, and a plurality of spring clamps 20. The spring clamps 20 are mounted to the evaporator block 14 and are configured to bias the first surface 22 of the evaporator block 14 against an exterior surface 24 of the underwater platform 12 such that heat from the exterior surface 24 of the underwater platform 12 is transferred to an ambient environment 25 via the evaporator block 14, heat pipe, 16 and condenser block 18.

The underwater platform 12 shown in FIG. 1 is a remotely operated vehicle (ROV), but it is to be understood that the cooling apparatus is not limited to use with ROVs, but may be used with any underwater device that has waste-heat-generating components. The cooling apparatus 10 provides an effective means of passively transferring waste heat to an ambient environment 25 from the underwater platform 12. Suitable examples of the ambient environment 25 include, but are not limited to, large bodies of water such as the ocean and fresh water lakes. Another example of the underwater platform 12 is an enclosed, pressure-tolerant, sealed vessel which is unable to dissipate sufficient heat directly through the vessel wall to the outside environment. Design considerations or environmental factors may require the heat-generating components (see element 42 shown in FIG. 2B) to be located within a hull or placed in relation to other structures such that the underwater platform 12 has limited ability to dissipate heat directly to the ambient environment 25. In some applications, heat-generating components of the underwater platform 12 may be covered with adiabatic material (see FIG. 3B) that limits heat transfer to the ambient environment 25. For example, heat-generating components may be covered with thermally insulative materials such as ROV flotation (e.g. syntactic foam), ROV fairing (e.g. fiberglass), sand or sediment, water entrained volume with no open water circulation, etc. In such applications (i.e., where the heat-generating component is covered with thermally insulative materials), the evaporator block 14 may be placed against the heat-generating component in the insulated environment such that heat absorbed by the evaporator block 14 is transferred via the heat pipe 16 away from the insulated environment to the condenser block 18, which is disposed in the ambient environment 25. For example, in embodiments where the underwater platform 12 has been partially or completely buried by sediment on the seafloor (such as is depicted in FIG. 3B), the cooling apparatus 10 can improve system reliability by moving the heat sinking away from the seafloor.

The evaporator block 14 is fabricated from a thermally conductive material. The first surface 22 is shaped so as to releasably mate to a contour of the exterior surface 24 of the underwater platform 12. The embodiment of the evaporator block 14 shown in FIG. 1 has a split clamp design with two halves 26 and 28 that may be fastened together forming a cylindrical bore 30 in which the heat pipe 16 may be disposed. The two halves 26 and 28 may be held together with bolts that also sandwich the heat pipe 16, and any thermal interface material, between the two halves 26 and 28 as the bolts are tightened. In the embodiment of the cooling apparatus 10 shown in FIG. 1, the first surface 22 of the second half 28 of the evaporator block 14 is concave, which enables the evaporator block 14 to mate to the exterior surface 24 of the ROV, which in this case has a cylindrical contour. It is to be understood that the first surface 22 may be any desired shape that mates with the exterior surface 24.

The heat pipe 16 is a two phase heat transfer device. The heat pipe 16 may comprise a sealed tube, interior wicking structure, and working fluid. The heat pipe 16 is designed to utilize the working fluid, internal wick structure and gravity/capillary action, as is known in the art, to allow for substantially greater equivalent thermal conductivity than can be achieved (e.g., 100-200 times greater) with solid metals such as aluminum and copper. This thermal conductivity performance is achieved using the phase transition of the working fluid which turns into a vapor on the heated side and travels along the heat pipe 16 to the cold side where it then condenses into a liquid. The liquid then returns to the heated side by capillary action and/or gravity and the process repeats. In FIG. 1, the heat pipe 16 has an evaporator section 32 and a condenser section 34. The cylindrical bore 30 forms a mating contact surface for the evaporator section 32 of the heat pipe 16.

The evaporator section 32 of the heat pipe 16 is shown placed below the condenser section 34 to allow gravity to aid in the heat transfer process. The evaporator section 32 is in thermal communication with the evaporator block 14. Likewise, the condenser section 34 is in thermal communication with the condenser block 18. The heat pipe tube material is traditionally manufactured from annealed copper, but different materials may also be used. The heat pipe tube can be fashioned from various metals and alloys including, but not limited to, copper-nickel (Cu—Ni), copper (Cu), copper-beryllium (Cu—Be), and titanium (Ti). For example, in one embodiment of the cooling apparatus 10, the heat pipe 16 is suited to external pressure in underwater environments having a tube manufactured of copper-nickel 70/30 or other suitable high strength material. Additionally, the heat pipe 16 is hermetically sealed so as to keep the internal working fluid from mixing with the ambient environment 25. The heat pipe 16 may be designed to meet the thermal conductivity requirements of many different applications. The type of internal working fluid is selected based on the working temperature range of the heat pipe application. Suitable examples of the working fluid include, but are not limited to, water, methanol, ammonia, sodium, mercury, and others.

The condenser block 18 may be held in ambient water away from the surface of the underwater platform 12 by the heat pipe 16 or by supporting structure of the underwater platform 12. The embodiment of the condenser block 18 shown in FIG. 1, is analogous to the evaporator block 14 (also shown in FIG. 1) with a split-clamp-bolt design with a first condenser half 36 coming together with a second condenser half 38 to form a second cylindrical bore 40 that serves as a contact surface of the condenser section 34 of the heat pipe 16.

The spring clamps 20 are attached to the evaporator block 14 and are designed to bias the evaporator block 14 to the exterior surface 24 of the underwater platform 12. In some environments such as the ocean, there can be tremendous pressure differences exerted on the underwater platform 12. Sometimes, that pressure can cause parts of the underwater platform 12 to contract radially inward as a function of increasing water pressure surrounding it. The spring clamps 20 provide a continuous clamp hold on the evaporator block 14 and the underwater platform 12 even as parts of the underwater platform 12 contract radially. The spring clamps 20 shown in FIG. 1 are spring-loaded band clamps. They work by providing pre-loaded clamping to secure the evaporator block 14 to the underwater platform 12 as ambient pressure changes. In addition to allowing constant thermal communication between the evaporator block 14 and the underwater platform 12, the spring clamps 20 allow the cooling apparatus 10 to be quickly attached and removed from the underwater platform 12 without any changes/modifications being made to the underwater platform 12. The cooling apparatus 10 is not platform-specific, but may be used on any underwater platform 12 by adjusting the strength and size of the spring clamps 20 and the contour of the first surface 22.

Figure 2A:
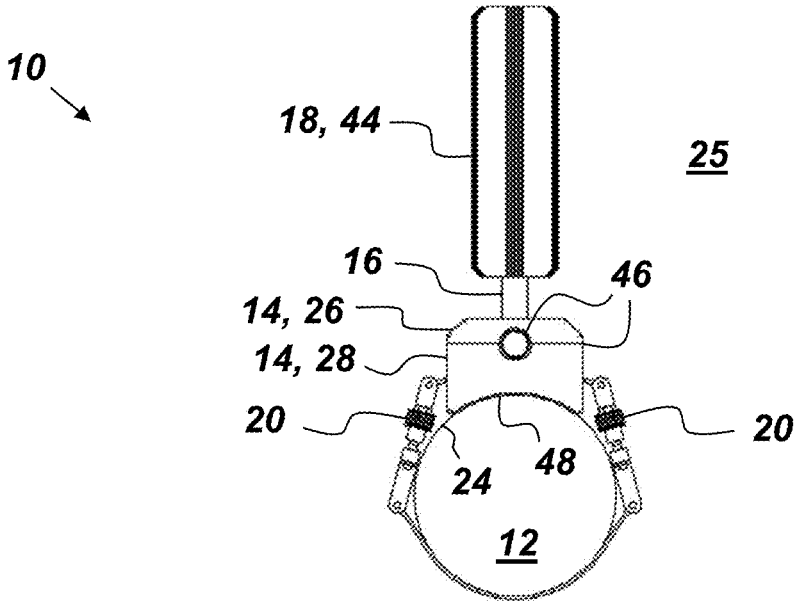
FIG. 2A is a front view of an embodiment of a cooling apparatus for an underwater platform.
Figure 2B:
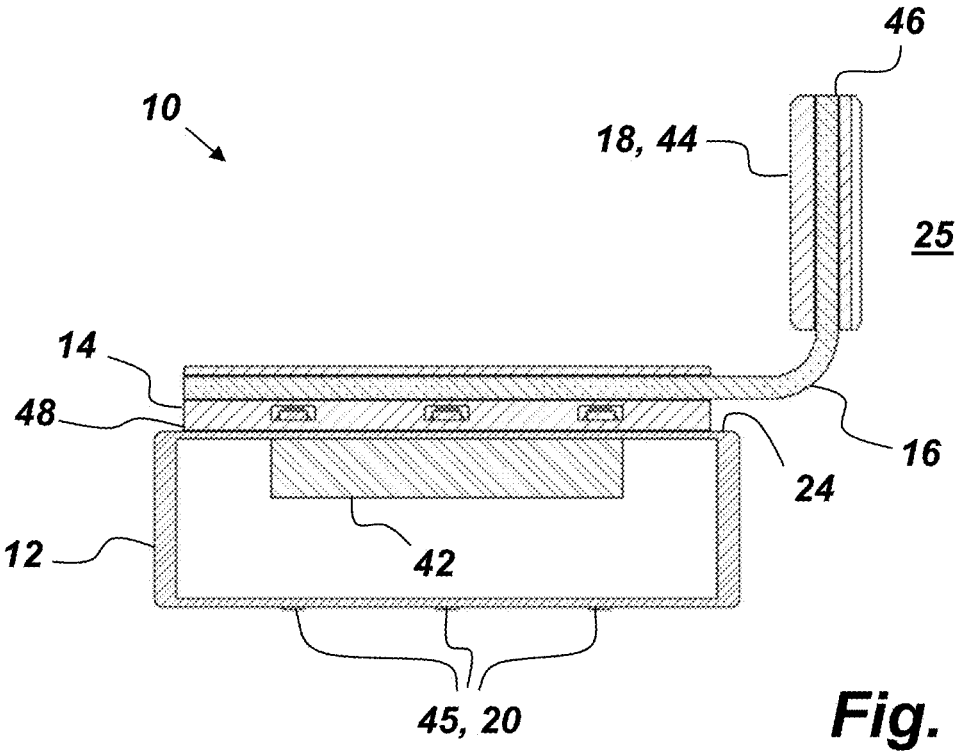
FIG. 2B is a cross-sectional, side view of an embodiment of a cooling apparatus for an underwater platform.

FIGS. 2A and 2B are front and cross-sectional side views respectively of an embodiment of the cooling apparatus 10. In this embodiment of the cooling apparatus 10 (i.e., the one depicted in FIGS. 2A and 2B), the underwater platform 12 is a pressure vessel having a cylindrical shape, which contains internal components 42 subjected to high heat generation such as a motor controller. Also in this embodiment of the cooling apparatus 10, the condenser block 18 further comprises fins 44 that increase the surface area of the condenser block 18 to facilitate heat transfer to the ambient environment 25. Visible in FIG. 2B are the bands 45 of the spring clamps 20.

The cooling apparatus 10 may further comprise a first thermal interface material 46 disposed between the condenser block 18 and the heat pipe 16. The first thermal interface material 46 interfaces between all discrete mating components (e.g., first and second condenser halves 36 and 38 and fins 44) of the condenser block 18. The first thermal interface material 46 may also be used between the heat pipe 16 and the evaporator block 14 and between halves 26 and 28 of the evaporator block 14. Suitable examples of the first thermal interface material 46 include, but are not limited to, thermal gap pads and greases using non-metallic or ceramic, thermally conductive materials in a low modulus matrix. The first thermal interface material 46 reduces thermal resistance between discrete components by increasing the contact area between imperfectly smooth surfaces. Higher contact pressure between the two mating components and thermal interface material 46 typically decreases thermal resistance leading to improved thermal conductivity.

The cooling apparatus 10 may further comprise a second thermal interface material 48 disposed between the first surface 22 of the evaporator block 14 and the exterior surface 24 of the underwater platform 12. The second thermal interface material 48 is a high-thermal-conductivity, low-modulus, elastic material. Analogous to the first thermal interface material 46, the second thermal interface material 48 provides effective thermal conductivity when the mating surfaces are placed under compression. The second thermal interface material 48 may be distinctly different in composition and thickness compared with the first thermal interface material 46. A suitable example of the second thermal interface material 48 includes, but is not limited to, a non-electrically-conductive thermal gap pad. It is desirable to electrically isolate different metallic parts to prevent galvanic corrosion in a seawater environment. The second thermal interface material 48 may consist of an elastomer matrix (e.g. silicone), a conductive filler material (e.g. boron nitride), and optionally a layer of reinforcing "skin" (e.g. fiberglass) for handling and installation purposes.

Figure 3A:
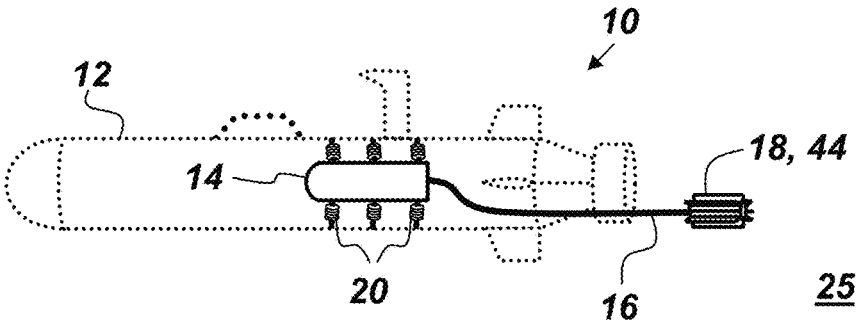
FIG. 3A is a side view of an embodiment of a cooling apparatus for an underwater platform.
Figure 3B:
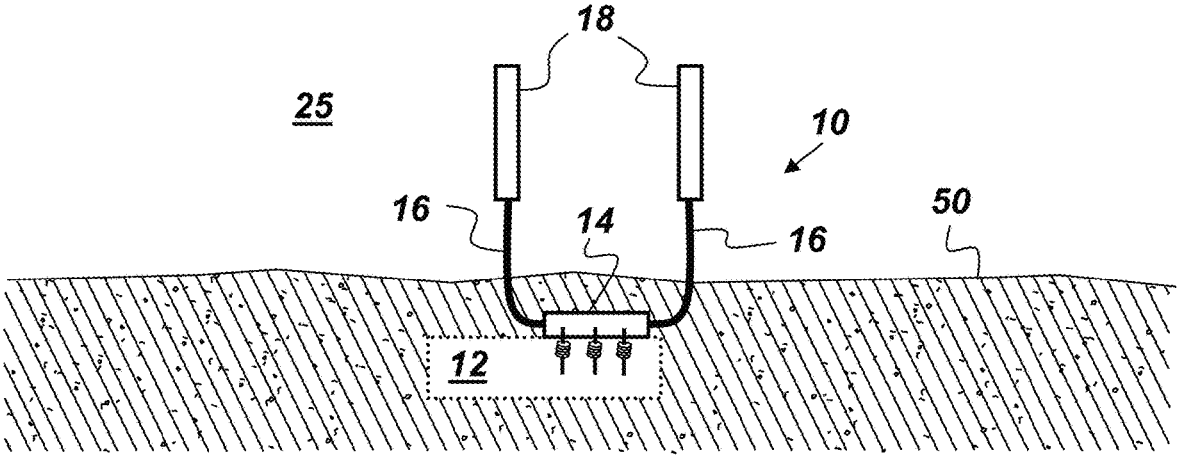
FIG. 3B is a side view of an embodiment of a cooling apparatus for an underwater platform.

FIG. 3A is a side view illustration of an embodiment of the cooling apparatus 10 where the cooling apparatus 10 is clamped to an autonomous underwater vehicle (AUV) embodiment of the underwater platform 12. Also in this embodiment, the condenser block 18 comprises heat sink fins 44 and the heat pipe 16 is routed in such a way so as to reduce drag. In this iteration, the heat sink fins 44 are extended fin surfaces utilizing free and forced convection for heat transfer to the ambient environment 25.

FIG. 3B is a side view illustration of an embodiment of the cooling apparatus 10 where the cooling apparatus 10 is used in conjunction with an underwater data center as the underwater platform 12. In the case of underwater data centers, drag will likely not be an issue, and the condenser block 18 is positioned so as to stand up free in the water column. The underwater data center shown in FIG. 3B is a self-contained system that is located on the seafloor 50. In fact, the underwater platform 12 and the evaporator block 14 in this embodiment are buried (either intentionally or accidently) in the seafloor 50. The underwater platform 12 may contain a number of pressure vessels or other components (e.g., onboard computer servers) required to dissipate significant amounts of heat. Seafloor-mounted systems by their nature are often exposed to a number of changing environmental conditions including silt accumulation, scouring, and partial or complete burial. These conditions may lead to decreased or a complete loss of heat dissipating ability where burial or silt accumulation acts as an insulating layer between the heatsink and seawater. The cooling apparatus may function with the underwater platform 12 and the evaporator block 14 being completely or partially covered in insulating material. The cooling apparatus 10 is applicable to any underwater platform 12 which may be subjected to external pressure and which has an external surface to which the evaporator block 14 may be clamped. The cooling apparatus 10 overcomes heat-transfer challenges faced by traditional methods due to environmental conditions including, but not limited to, confined geometry, space or weight constraints, environmental factors such as surface buildup or location in unsuitable environmental medium as described above.

The cooling apparatus 10 is maintenance-free and features a sealed working fluid within the heat pipe 16. The cooling apparatus 10 also permits a simplified underwater platform 12 design that does not require special features or special attachment points to accommodate the cooling apparatus 10. The adaptable design nature of heat pipes allows for complex routing of the heat to a more suitable/efficient location for heat transfer to the ambient environment 25. The cooling apparatus 10 allows the underwater platform 12 and evaporator block 14 to be placed in insulating locations or environments which may limit direct heat transfer to the ambient environment 25. The spring clamps 20 allow the underwater platform 12 to be readily disassembled from the evaporator block 14 for servicing. The cooling apparatus 10 may be positioned on the underwater platform 12 to take advantage of the often localized nature of heat generating components within the underwater platform 12, thus enabling efficient dissipation of heat. The embodiment of the cooling apparatus 10 shown in FIG. 3B comprises two heat pipes 16 and two condenser blocks 18. The number of evaporator blocks 14, heat pipes 16, and condenser blocks 18 may be increased in quantity, shape, or size to meet application requirements for heat dissipation, environmental pressure, external dimensions, weight, etc.

Figure 4:
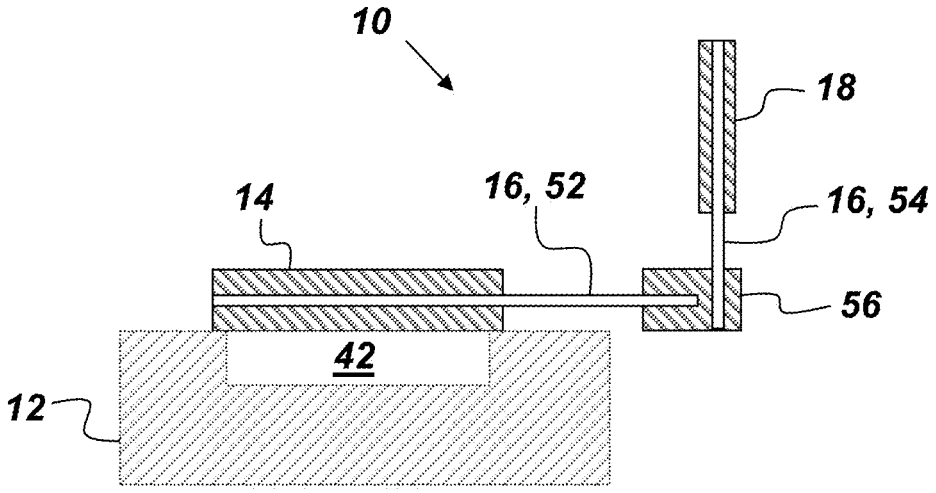
FIG. 4 is a cross-sectional, side view of an embodiment of a cooling apparatus for an underwater platform.

FIG. 4 is a cross-sectional, side-view illustration of an embodiment of the cooling apparatus 10 where the heat pipe 16 comprises first and second heat pipes 52 and 54 and a junction block 56 made of thermally-conductive material. The first and second heat pipes 52 and 54 are arranged in series and are connected by the junction block 56. This embodiment of the cooling apparatus 10 (i.e., the one depicted in FIG. 4 having two straight heat pipes 52 and 54 connected together) simplifies the right-angle bend of the heat pipe 16 as used in the embodiment of the cooling apparatus shown in FIG. 1. Additionally, heat pipes can be used in parallel, and laid beside each other to transfer more heat than a single heat pipe alone. The evaporator block 14 may be larger than the internal heat generating component 42 as heat will spread across the exterior surface 24 of the underwater platform 12 beyond the profile of the internal heated component 42. The evaporator block 14 should not be directly tied to the pressure vessel (e.g., bolted thereto)—not only does this make it easier to install/service the cooling apparatus 10, but the spring claims 20 allow the evaporator block 14 to be in continuous thermal communication with the underwater platform 12 as its shape changes with external pressure differences.

From the above description of the cooling apparatus 10, it is manifest that various techniques may be used for implementing the concepts of the cooling apparatus 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the cooling apparatus 10 is not limited to the particular embodiments described herein, but is capable of many embodiments without departing from the scope of the claims.

We claim:

1. A cooling apparatus for an underwater platform comprising:

an evaporator block fabricated from a thermally conductive material and having a first surface that is shaped so as to releasably mate to an exterior surface contour of the underwater platform;

a heat pipe having a working fluid sealed therein, wherein the heat pipe has a first end and a second end, and wherein the first end is in thermal communication with the evaporator block;

a condenser block in thermal communication with the second end of the heat pipe, wherein the condenser block is held in ambient water away from the surface of the underwater platform by the heat pipe; and a plurality of spring clamps mounted to the evaporator block and configured to bias the first surface of the evaporator block against the exterior surface of the underwater platform such that heat from the exterior surface of the underwater platform is transferred to the ambient water via the evaporator block, heat pipe, and condenser block.

2. The cooling apparatus of claim 1, further comprising heat sink fins connected to the condenser block and in physical contact with the ambient water.

3. The cooling apparatus of claim 2, further comprising a thermal interface material disposed between the condenser block and the heat pipe and between the evaporator block and the heat pipe.

4. The cooling apparatus of claim 3, further comprising an evaporator interface material being elastic and electrically-non-conductive and disposed between the evaporator block and the surface of the underwater platform.

5. The cooling apparatus of claim 4, wherein the underwater platform is a remotely operated vehicle (ROV).

6. The cooling apparatus of claim 4, wherein the underwater platform is stationary equipment located on a seafloor.

7. The cooling apparatus of claim 6, wherein the data center is buried beneath the seafloor and the condenser block is disposed above the seafloor.

8. The cooling apparatus of claim 5, wherein the ROV comprises a cylindrical pressure vessel to which the evaporator block is releasably mated, wherein the cylindrical pressure vessel shrinks as external pressure increases as the ROV descends through the ambient water, and wherein the plurality of spring clamps continues to bias the first surface of the evaporator block against the exterior surface of the underwater platform as the ROV moves through the water.

9. The cooling apparatus of claim 1, wherein the underwater platform is a hydraulic cylinder.

10. The cooling apparatus of claim 1, further comprising an insulating layer surrounding the underwater platform and the evaporator block.

11. The cooling apparatus of claim 4, wherein the evaporator block comprises:

a first half;

a second half bolted to the first half; and a cylindrical bore formed at the interface of the first and second halves, in which the heat pipe, surrounded by a thermal interface material, is disposed such that as the first and second halves are being bolted together the heat pipe is clamped in the cylindrical bore and the thermal interface material surrounding the heat pipe is sandwiched between the first and second halves and the heat pipe.

12. A cooling apparatus for an underwater platform comprising:

an evaporator block fabricated from a thermally conductive material and having a first surface that is shaped so as to releasably mate to an exterior surface contour of the underwater platform;

a heat pipe having a working fluid sealed therein, wherein the heat pipe has a first end and a second end, and wherein the first end is in thermal communication with the evaporator block;

a condenser block in thermal communication with the second end of the heat pipe, wherein the condenser block is held in ambient water away from the surface of the underwater platform by the heat pipe;

a plurality of spring clamps mounted to the evaporator block and configured to bias the first surface of the evaporator block against the exterior surface of the underwater platform such that heat from the exterior surface of the underwater platform is transferred to the ambient water via the evaporator block, heat pipe, and condenser block; and wherein no part of the cooling apparatus extends into an interior space of the underwater platform.

13. The cooling apparatus of claim 12, further comprising heat sink fins connected to the condenser block and in physical contact with the ambient water.

14. The cooling apparatus of claim 13, further comprising a non-electrically-conductive, thermal interface material disposed between the condenser block and the heat pipe.

15. The cooling apparatus of claim 14, further comprising a non-electrically-conductive, elastic evaporator interface material disposed between the evaporator block and the surface of the underwater platform so as to electrically isolate the evaporator block and the underwater platform to prevent galvanic corrosion.

16. The cooling apparatus of claim 15, wherein the non-electrically-conductive, elastic evaporator interface material consists of an elastomer matrix, a conductive filler material, and a layer of reinforcing fiberglass skin.

17. The cooling apparatus of claim 16, wherein the heat pipe is made of a copper-nickel alloy and the working fluid is selected from the group consisting of: water, methanol, ammonia, sodium, and mercury.

18. The cooling apparatus of claim 12, wherein the heat pipe comprises two separate heat pipes joined together with a junction block.

19. The cooling apparatus of claim 13, wherein the underwater platform is an autonomous underwater vehicle (AUV) and wherein the condenser block is disposed with respect to the AUV so as to trail behind the AUV.

* * * * *